US005129120A

United States Patent [19]

Cornette et al.

[11] Patent Number: 5,129,120

[45] Date of Patent: * Jul. 14, 1992

[54] PROCESS FOR WASHING FABRICS IN A MACHINE

[75] Inventors: Henri Cornette, Pontoise, France; Jose Arnau-Munoz, Madrid, Spain

[73] Assignee: The Procter & Gamble Company, Cincinnati, Ohio

[ * ] Notice: The portion of the term of this patent subsequent to Jun. 6, 2006 has been disclaimed.

[21] Appl. No.: 576,111

[22] Filed: Aug. 24, 1990

Related U.S. Application Data

[63] Continuation of Ser. No. 463,913, Jan. 10, 1990, abandoned, which is a continuation of Ser. No. 309,447, Feb. 10, 1989, abandoned.

[30] Foreign Application Priority Data

Feb. 11, 1988 [FR] France ..... 88 01657

[51] Int. Cl.[5] ..... D06F 39/02

[52] U.S. Cl. ..... 8/158; 8/137; 68/17 R; 206/0.5; 252/90; 252/95

[58] Field of Search ..... 8/137, 158, 159; 68/17 R, 17 A, 235; 252/90, 92, 95; 206/0.5, 216; 222/158, 478

[56] References Cited

U.S. PATENT DOCUMENTS 4,654,395 3/1987 Schulz et al. ..... 252/90 X
4,703,872 11/1987 Cornette et al. ..... 68/17 X
4,835,804 6/1989 Arnau-Munoz et al. ..... 68/17 X

*Primary Examiner*—Philip R. Coe
*Attorney, Agent, or Firm*—Jerry J. Yetter; Jacobus C. Rasser

[57] ABSTRACT

A device comprising unoccluded vents and containing a detergent is employed. This device is placed with fabrics to be washed in the drum of a washing machine and the machine is started up, allowing the washing cycle to proceed. A detergent composition some of whose constituents are separate is employed and at least one of the constituents is introduced into the device and at least one other of the constituents is associated separately with the said device, so that during the washing all the constituents diffuse into the fabrics and the washing bath.

2 Claims, 4 Drawing Sheets

FIG. 15
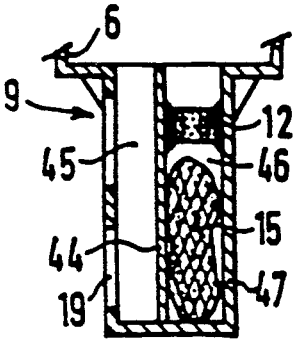
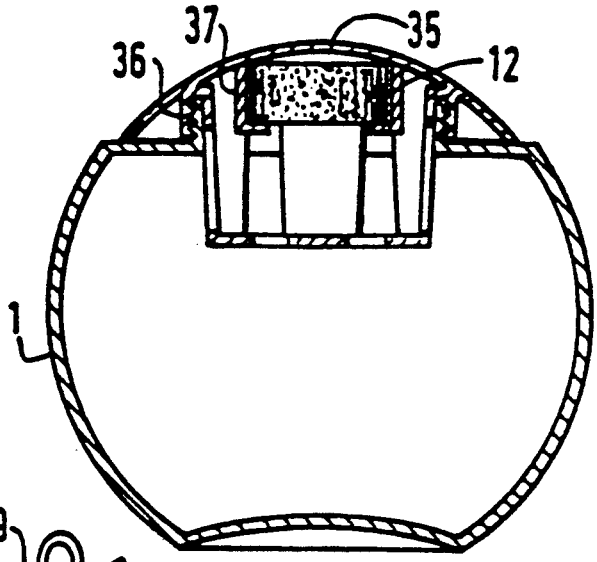
FIG. 12
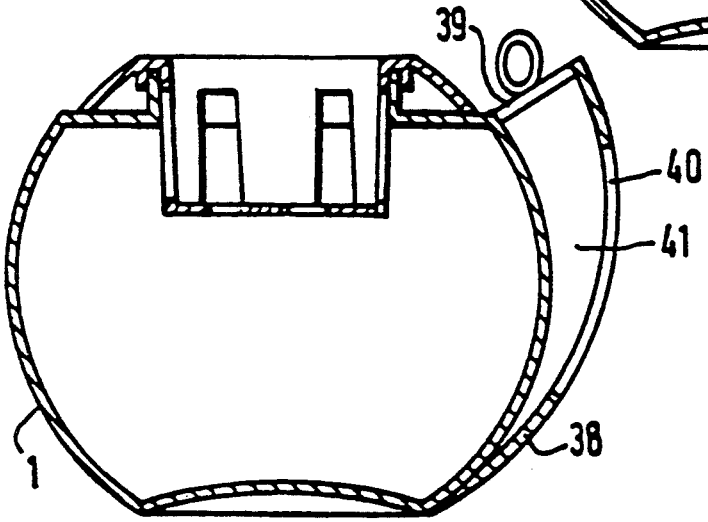
FIG. 13
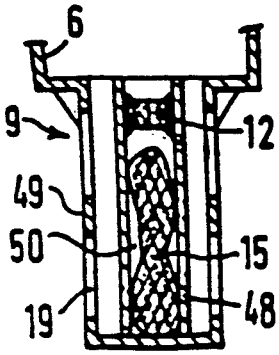
FIG. 16
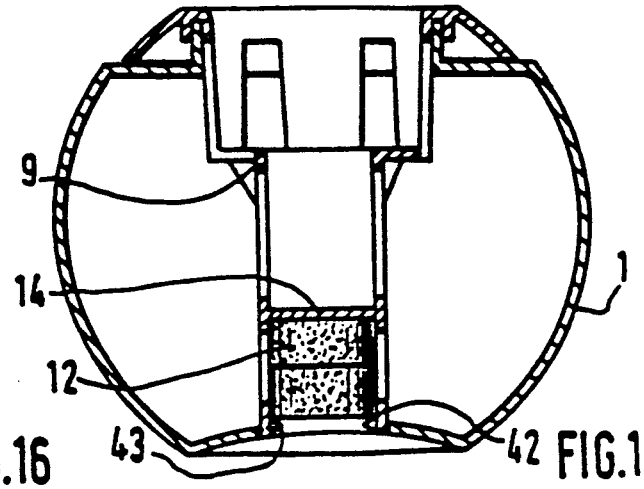
FIG. 14

PROCESS FOR WASHING FABRICS IN A MACHINE

This is a continuation of U.S. application Ser. No. 463,913, filed on Jan. 10, 1990, which is a continuation of U.S. application Ser. No. 309,447, filed on Feb. 10, 1989.

TECHNICAL FIELD

The present invention relates to the field of washing and cleaning of fabrics in a machine.

BACKGROUND INFORMATION

European Patent Application No. 85/400,652.5, published under No. 0,151,549, in the name of The Procter & Gamble Company, describes an original process for washing fabrics in a machine with a liquid detergent. According to this process, a device containing a liquid detergent and comprising unoccluded vents, is employed. This device is placed with the clothing to be washed in the drum of the machine and the machine is started up allowing the washing cycle to proceed, with the detergent thus flowing progressively into the fabrics and the washing bath as soon as the machine is started up. According to an embodiment, a predetermined quantity of liquid detergent is poured into the device, which comprises a filling orifice for this purpose and, at the end of the washing, the device is recovered and may be reused. A process of this kind improves the efficiency of the washing of fabrics in a machine very appreciably and it is widely developed, with great commercial success in Europe.

Devices permitting the use of the process indicated above are described, for example, in U.S. Pat. No. 4,703,872, issued Nov. 3, 1987 to Cornette et al. A device of this kind comprises at least one filling orifice and vents for the progressive release of the liquid within the fabrics in the course of washing. By way of example, the device comprises a body and an added assembly which is intended for filling and/or for distributing the liquid. An assembly of this kind can be mounted permanently onto the body or, on the other hand, may be removable. An assembly of this kind may comprise a central filling orifice and vents distributed at its periphery. According to an advantageous embodiment, the filling orifice is in the shape of an open shaft descending inside the body. It will also be noted that an arrangement which is advantageous in practice consists in imparting an essentially spherical shape to the device. Nevertheless, this shape is not limiting in any way, and for example, other shapes of revolution may be used.

For the purpose of washing, the device is filled with liquid detergent and, thus filled, it is placed in the drum of the machine, where the fabrics are already present, the liquid detergent contained in the device being progressively distributed in the course of washing within the washing medium and within the fabrics.

It is desirable to have available a simple process capable of being implemented with inexpensive devices, in order to solve simultaneously a number of technical problems which arise with the detergent compositions currently available commercially. The first problem to be solved is to place at the user's disposal a process and a device for adapting the washing conditions to the degree of soiling of the fabrics, in order thus to provide "wash with options". This problem is general and it exists both in the case of liquid detergent compositions and in the case of compositions which are in particulate form. An additional problem results from the fact that it is desirable to perform the washing of fabrics with a detergent composition whose constituents exert their activity at their optimum time, both by being involved in the washing process, for example in order to play a role in protecting the components of the washing machine, and in order to fulfill their specific function during the washing, which is the case, for example, with enzymes, softeners, grease stain removers, peroxygen compound, bleaching catalysts, bleaching activators, bactericides, foam regulators, optical brighteners and other similar constituents with a specific function. Such constituents must be available at determined times during the washing cycle and the technical problem to be solved is to find a simple and practical process for presenting these constituents so as to make them available for the washing to proceed according to a predetermined and optimum sequence.

Another problem to be solved, which arises more particularly in the case of liquid detergents, is that of the mutual incompatibility of certain constituents of the composition with regard to others. This incompatibility may be more or less pronounced, but people who specialize in this subject are well aware of this problem. It is also desirable to deliver certain constituents of the composition in a separate form so as to enable them to have a delayed effect by virtue, for example, of their being dissolved more slowly during the washing.

The invention provides a solution to the problems just mentioned, whatever the type of detergent employed, and does so while exploiting the currently existing devices which are described, for example, in the above mentioned U.S. Pat. No. 4,703,872 and which have in practice been found highly appropriate for the use of the general washing technique described particularly in the above mentioned European Patent Application 0,151,549.

SUMMARY OF THE INVENTION

In order to solve the technical problems set out above, and others, the subject matter of the invention is an improved process for washing fabrics in a machine, in which a device comprising unoccluded vents and containing a detergent is employed, this device is placed with the fabrics to be washed in the drum of the machine and the machine is started up allowing the washing cycle to proceed, the said process being characterized in that a detergent composition is employed some of whose constituents are separate, in that at least one of the said constituents is introduced into the device and in that at least one other of the said constituents is associated separately with the said device with the result that, during the washing, all of the constituents diffuse into the fabrics and the washing bath.

According to the invention, the process can be applied to detergent compositions some of whose constituents have a specific mode of action on the soiling. It may also be employed in the case where some constituents are insufficiently compatible with others within the detergent composition.

Nonlimiting examples of constituents which may be separated in the process according to the invention from the detergent composition as such are: bleaching agents such as agents releasing chlorine or active oxygen (peroxygen compound), brightening agents, agents preventing redeposition of the soiling, enzymes, softeners and grease stain removers. Such constituents have a specific action on the soiling, which takes place either at the beginning of the washing cycle or during the latter. The process of the invention may also be employed for using agents which, strictly speaking, do not act directly on the soiling, but which can nevertheless be involved in a process of washing linen in a machine. This is the case particularly with agents which provide protection of the internal parts and components of the washing machine, for example agents based on sodium silicates.

According to the invention, the fact of combining with the device at least one constituent which has a specific mode of action on the soiling means both that a constituent of this kind is made integral with the device as soon as the latter is placed in the machine and as soon as the washing cycle begins or else that a constituent of kind is presented in a separate form in order to produce its effects during the washing cycle, in combination with the other constituents contained in the device.

It can be seen, therefore, that there are many possibilities of associating these separate constituents with the device containing the detergent, depending on the nature of these constituents and their mode of action. Illustrative examples, which do not imply any limitation, will be given in the description which follows.

Thus, the constituents presented in a separate form may be contained in pouches or sachets, for example as an individual measured quantity, made of a nonwoven substance or, on the other hand, of a substance which is soluble in the washing bath (for example of PVA polyvinyl alcohol). These constituents may also be gelatin capsules or tablets or pastilles which are soluble in the washing bath, as well as granules, sheets, for example nonwoven, impregnated or coated with active ingredients, or substances having the consistency of a paste.

In an embodiment of the process, the detergent composition as such is presented in liquid or granular form and is supplied individually to the user. The latter also has available products or constituents with a specific action which are offered to him separately and, for example, have tints or colors which are characteristics for each of them, so that the user may adapt the formulation of the detergent composition to the precise need of the washing, as a function of the state of soiling of the fabrics, according to indications he is given. In the same way, the problem of an insufficient incompatibility of some constituents of the detergent composition can be solved. A separate and delayed action of certain constituents, such as bleaching agents can also be produced, by virtue of their separate presentation which enables them to dissolve more slowly during the washing cycle.

As mentioned before, the process of the invention may be implemented with a device or receptacle which is very simple, for example of the general type described in U.S. Pat. No. 4,703,872.

The constituents presented separately, according to the invention, are advantageously integral with the device or receptacle placed in the drum of the washing machine.

For this purpose, the device or receptacle may comprise housings, for example in its outer periphery, which are capable of receiving the separate constituents in any of the above-mentioned forms.

However, it is also possible to exploit the structure of the currently known devices or to modify it slightly so as to arrange the separate constituents in question in the device.

By way of example, if a receptacle comprising a body of revolution and an assembly, removable or not, with a central filling orifice in the shape of an open shaft, and vents distributed on its periphery, is available, then, once the detergent composition has been placed in the body of the receptacle, it is possible to house in the open shaft the constituents of the said composition which are intended to be associated with the receptacle and which are, for example, presented in the form of a sachet made of a nonwoven substance or soluble in the washing bath. However, it is also possible to provide a receptacle comprising a double open shaft, one permitting filling with the detergent composition as such and the other being used for placing the sachets, which then have a specific housing. If these sachets are made of a nonwoven substance they are simply recovered at the end of the washing operation. The open shaft(s) in question may be left free in their upper part or may, on the other hand, comprise a snap-on lid or a movable lid, for example with a hinge, so as to enclose the constituents in their housings and to let them diffuse through the vents of the receptacle at the same time as the remainder of the detergent composition.

Forms of presentation of the separate constituents in units which correspond to a solid structure or one that can be handled like a solid have been primarily indicated above and are preferable. However, these constituents may also be presented in a different form, for example as a liquid or gel. In such cases, theses separate constituents of the detergent composition as such may be placed in the receptacle in an individual housing. The receptacle may be supplied to the user with a housing which is thus filled in advance, in which case it suffices to fill the receptacle with detergent and to unblock the opening of this housing, in order to permit the diffusion of the detergent as well as of the constituent which has already been placed in position.

However, it is not a departure from the scope of the invention to employ a receptacle or device of a general design such as described in U.S. Pat. No. 4,703,872 for example, and to present a particular constituent separately, because of its specific action, so long as this constituent is associated, at the time of use, with the receptacle in question, that is to say that it is placed in the machine with this receptacle.

The person skilled in the art will therefore understand that the process of the invention may be implemented with a very wide variety of devices or of receptacles, the examples given above being merely for guidance and not limiting in any manner.

The invention contributes a simple and efficient solution to the technical problems mentioned at the beginning of the present specification. In the prior art, certain processes for washing fabrics in a machine involved the use of a machine capable of picking up from separate vats the corresponding ingredients of a detergent formulation. This technical solution is extremely complicated, because not only does the structure of the machines have to be modified, but also costly programming equipment which comes into operation as the washing cycle progresses must be provided.

On the other hand, the process of the invention exploits all the advantages of simplicity and efficiency of the general technique of washing forming the subject matter of European Patent Application 0,151,549. To the advantages of this technique, namely a better washing efficiency and getting rid of the losses of detergent in the machine draining circuit, the invention adds a great flexibility of washing conditions, the user being in a position to perform a "wash with options" depending on the nature and the state of the fabrics to be washed and on the soiling to be removed.

The description which follows gives still further concrete examples of embodiment of the invention.

The invention will now be illustrated without being limited in any manner, with reference to the attached drawings, which illustrate devices permitting the use of the process of the invention, namely:

BRIEF DESCRIPTION OF THE DRAWINGS

FIG. 12 is an axial section of a device incorporating tablets in its upper part.

FIG. 13 is an axial section of a device having a housing on its outer wall.

FIG. 14 is an axial section of a device having a housing for tablets in its lower part.

FIG. 15 is an axial section illustrating an alternative construction of a component of the device.

FIG. 16 is an axial section illustrating another alternative construction.

DETAILED DESCRIPTION OF THE INVENTION

Figure 1:
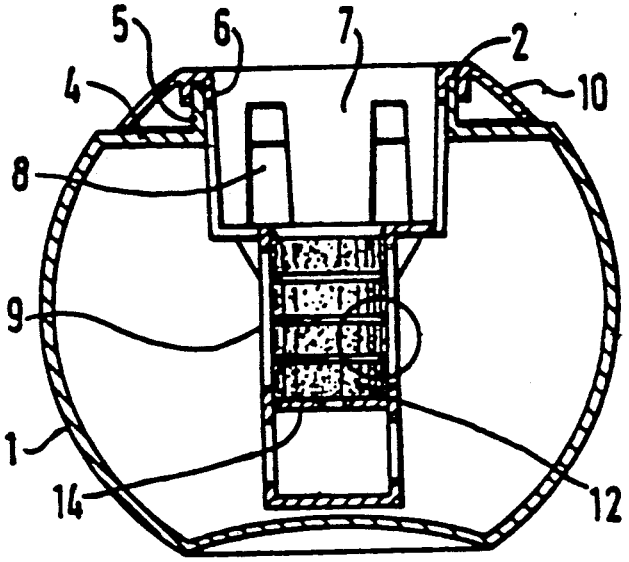
FIG. 1 is an axial section of a device incorporating constituents presented in the form of tablets or pastilles.

For the sake of simplicity of the description and uniformity of the text, most of the devices which will be described are of the general type forming the subject matter of U.S. Pat. No. 4,703,872. As illustrated in Figure in particular, they comprise a body 1 of generally spherical shape and an added assembly 2, to which the body 1 is attached by a planar surface 4 positioned radially and extended by a cylindrical surface 5 in an upward direction. The added assembly 2 comprises a bowl-shaped upper part 6 providing a central opening 7. The wall of the bowl 6 has peripheral perforations 8. The bowl 6 is extended downwards by a cylindrical part 9 in the form of an open shaft descending into the device 1, which is intended to be used as a receptacle for the detergent composition. Furthermore, the added assembly 2 also has parts 10, projecting outwards and at the periphery, which come to bear on the surface 4 of the body 1 and serve essentially as means of grasping.

The process of the invention may be advantageously used with a device of this type, which makes it possible to associate some separate constituents of the basic detergent composition which is introduced into the body 1.

In the embodiment illustrated in FIG. 1, a number of tablets containing ingredients or constituents having a specific function for the washing are placed inside the open shaft 9. As illustrated in detail in FIG. 2, the inner surface of the open shaft 9 may have annular projections 13 which make it possible to provide between them housings where the tablets 12 are housed respectively. In FIG. 1 it can also be seen that the open shaft is limited by a wall 14 situated at an intermediate level of its height, and this makes it possible to avoid having to push a tablet into the open shaft as far as its lowest level.

In the drawing of Figure the open shaft 9 has been illustrated as comprising lengthwise side openings, which are conventional in devices of this type that are already employed. However, for the requirements of the invention, it may be advantageous to provide an open shaft with continuous walls, so that the detergent, for example liquid, composition introduced into the body 1 does not immediately come into contact with the tablets housed in the open shaft. These embodiments depend on the type of constituents present in the tablets, as will be seen later. Also, FIGS. 1 and 2 illustrate tablets housed in the open shaft, but the same arrangements could be applied with constituents presented in the form of gelatin capsules or of any other structure having sufficient rigidity to be inserted and maintained in the open shaft.

Figure 2:
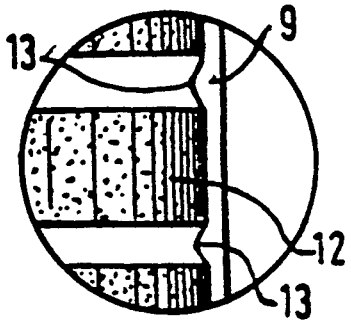
FIG. 2 is a view of the indicated detail of FIG. 1.
Figure 3:
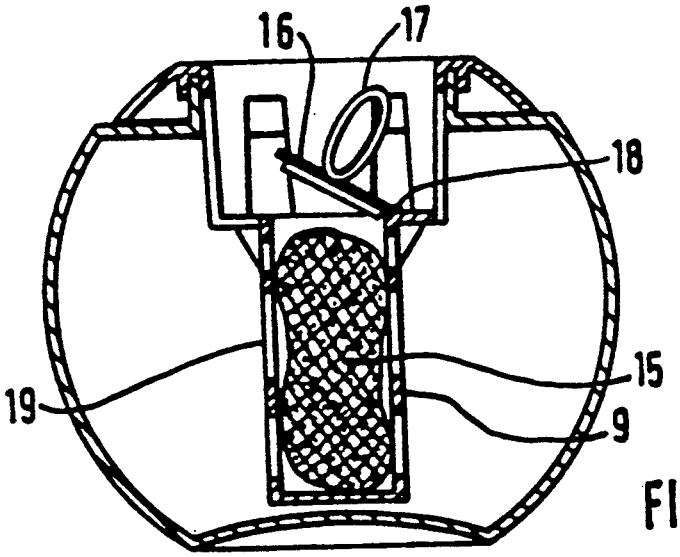
FIG. 3 is a view similar to FIG. 1, illustrating a device wherein some constituents are presented in a sachet or pouch.

To simplify matters, the description with reference to FIG. 3 of the device whose constituent parts are the same as those of the device in FIGS. 1 and 2 will not be repeated. In the alternative form shown in FIG. 3, the separate constituent(s) of the detergent composition is (are) presented in the form of a sachet or pouch 15 which is arranged inside the open shaft 9. FIG. 3 shows a lid 16 which can move around a hinge 18 and can be manipulated by a ring 17. This lid can be useful if the substance of which the sachet 15 is made is a nonwoven textile which does not dissolve in the washing bath, in which case it is better, when the washing is finished, to prevent the sachet from escaping from the device and possibly causing damage to the mechanical components of the washing machine. In this case, the lid 16 is brought down onto the upper part of the open shaft, so that the latter is closed. As usual, the open shaft 9 has lengthwise openings 19 which also make it possible to bring the sachet into contact with the washing liquid, to ensure the diffusion of the constituent which it contains. If the sachet 15 is made of a water-soluble material such as polyvinyl alcohol, it suffices to place it in the open shaft, which then does not need to be provided with a lid in its upper part.

Figure 4:
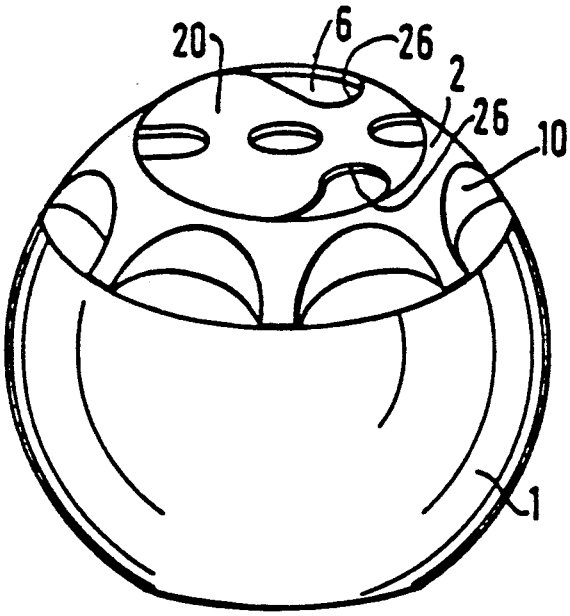
FIG. 4 is a perspective view of an alternative form of the device employing tablets.
Figure 6:
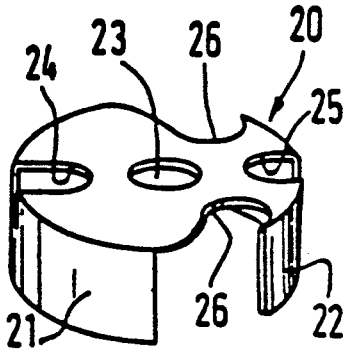
FIG. 6 is a perspective view of a component of the device in FIGS. 4 and 5.
Figure 5:
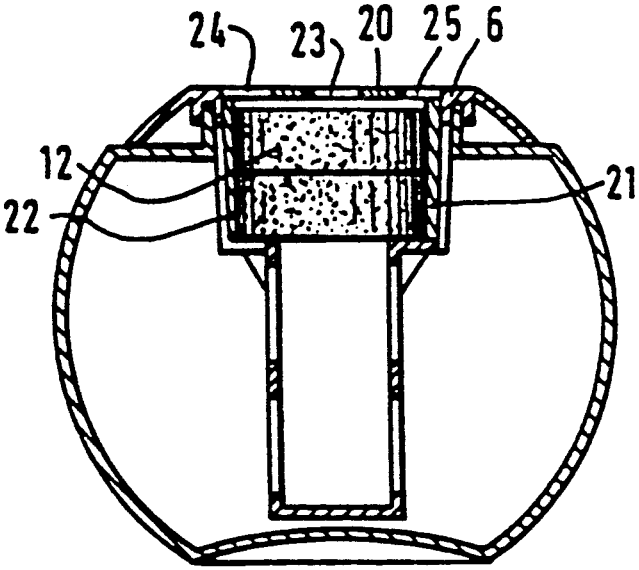
FIG. 5 is an axial section of the device of FIG. 4.

FIGS. 4 to 6 illustrate an alternative embodiment, according to which tablets of constituents which have a specific function for the washing are placed not in the open shaft as shown in FIGS. 1 to 3, but in the bowl 6 of the assembly 2 added onto the body 1. To maintain the tablet(s) 12 in this bowl 6, a component 20 has been provided, and this is pushed into the bowl, clamping the tablets. This component 20 is shown in perspective in FIG. 6. It can be seen that it has skirts 21, 22 in the form of cylindrical walls which extend vertically so as to match the vertical walls of the bowl 6, but only of a limited region of the latter, while passages or orifices 23, 24, 25 are also provided to permit subsequent diffusion of the active products into the washing bath. In its upper part, the component 20 also comprises two recesses 26, opposite each other, which makes it easier to grasp this component. FIG. 4 clearly shows the location of the device when the component 20 is placed in position and pushed into the bowl 6. This same arrangement appears in cross-section in FIG. 5, where two tablets 12 housed in the bowl 6 can also be seen.

Figure 7:
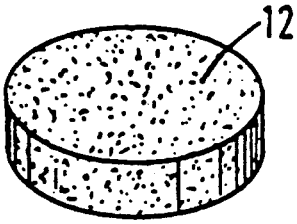
FIG. 7 is a perspective view of a tablet which can be employed in the process of the invention.

FIG. 7 illustrates a tablet which may be employed in any one of the above-mentioned devices, and also in those which will be illustrated later. A tablet of this kind may be obtained directly by compacting a substance which has an activity in the washing process, for example an inorganic compound such as a peroxygen compound, especially sodium perborate. However, it is also possible to use constituents with a specific function which are themselves not capable of forming a tablet and which must therefore be incorporated in a matrix or carrier which can dissolve under the washing conditions. This matrix may, for example, consist of calcium bicarbonate. Alternatively, the faces of the tablets may also be coated with a substance which is impervious to the aqueous medium, so that the progressive dissolution of the tablet takes place not via its main faces, but via its narrow section, and this can ensure a slower dissolution, which may be desirable in certain cases in order to ensure a predetermined sequence in the washing cycle.

Figure 8:
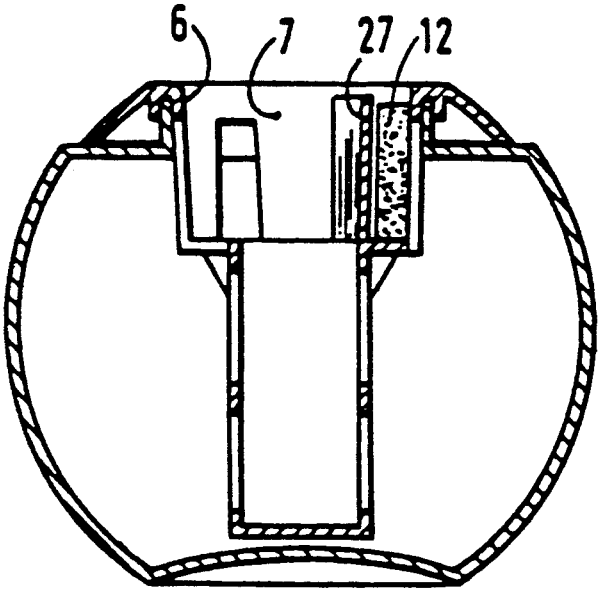
FIG. 8 is an axial section of a device showing another embodiment with constituents presented in the form of tablets.
Figure 9:
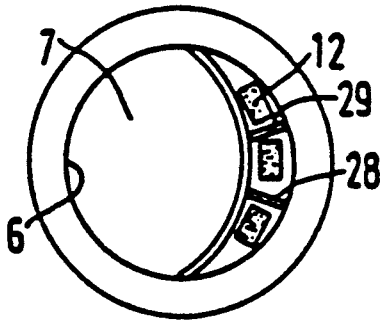
FIG. 9 is a top view of the part of the embodiment of FIG. 8 containing the tablets.

FIG. 8 illustrates an alternative form of a device according to which tablets or gelatin capsules are simply housed in the compartments arranged in the bowl 6. FIG. 9 which is a top view of the bowl 6 and of the central opening 7, shows that a crescent-shaped partition 27 extends across the bowl to form, together with radial partitions 28 and 29, housings into which tablets or gelatin capsules 12 can be inserted.

Figure 10:
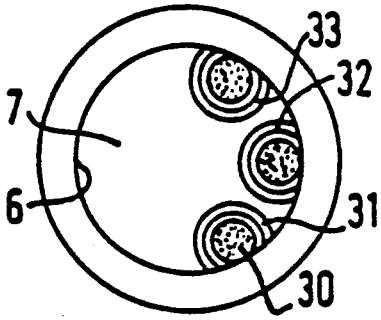
FIG. 10 is a view similar to FIG. 9 and illustrating an alternative embodiment.

FIG. 10 illustrates an alternative form according to which the partitions 27, 28, and 29 are replaced by cylindrical walls 31, 32, 33 which from corresponding cells in which stick-shaped tablets or gelatin capsules 30 can be housed.

Figure 11:
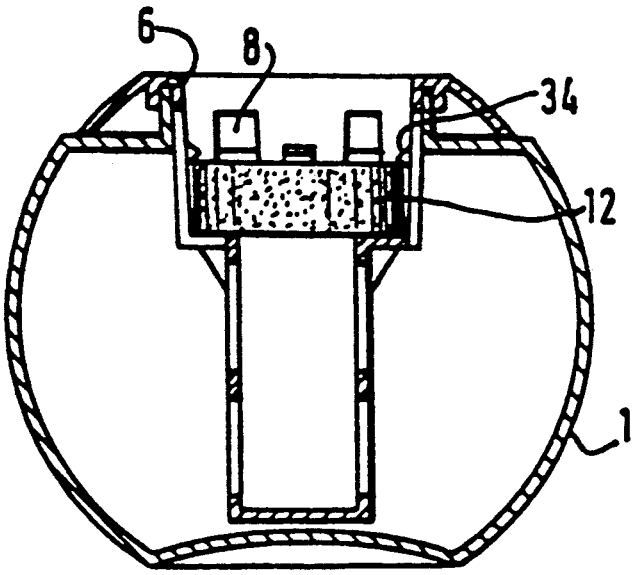
FIG. 11 is an axial section of another device which can be used with tablets.

FIG. 11 shows a device comprising a tablet 12 which is housed in the bottom of the bowl 6. To hold the tablet 12 in place, an annular rib 34 has simply been provided inside the bowl 6. To place the tablet 12 in position it suffices to push the latter into the bowl and the tablet is then held by its upper part. The rib 34 does not need to be continuous. It is sufficient for the wall 6 to comprise projections which act as stops when the tablet has been pushed in. Since all the components in question are made of plastic, the flexibility of the walls and ribs allows the tablets or gelatin capsules to be placed in position without any difficulty.

The devices illustrated in FIGS. 1 to 11 are of the type comprising an open shaft 9 descending inside of body 1, but this is not obligatory in any manner, as will be described with reference to FIGS. 12 and 13, if this open shaft is not employed for placing the solid product 12.

FIG. 12 shows a device of the type comprising a lid 35 screwed onto the body 1 by means of additional threading 36. In this alternative form, it is the lid 35 which comprises a cylindrical wall 37 which makes it possible to form a housing inside which a tablet 12 can be housed.

FIG. 13 illustrates a device without an open shaft, but comprising, for the purpose of the present invention, on at least a part of its peripheral surface, a wall 38 provided with openings 40 and capable of being closed with a removable lid 39. Active constituents for the washing, presented in the form of tablets, gelatin capsules, sachets and any other similar forms can be housed in the housing 41 formed between the wall 38 and the outer surface of the body 1.

FIG. 14 illustrates a device which is distinguished in that the open shaft 9 is limited by a wall 14 and that the lower part of the body 1 is arranged to form a housing 42 capable of receiving tablets 12, which may be held in place therein by annular ribs such as 43.

Shown diagrammatically in FIG. 15 is an arrangement of an open shaft 9 according to which a diametral partition 44 extends inside the open shaft, to form two cylindrical compartments 45, 46, semicircular in section. Compartment 45 is the only one to communicate with the part of the device corresponding to the bowl 6, where the liquid detergent enters the device and diffuses during the washing. The other compartment 46, is not in communication with the liquid and may house at least one tablet 12 and/or one sachet 15, as shown.

The cylindrical wall 47 of the open shaft 9 delimiting the compartment 46 is generally continuous, while the compartment 45 has openings 9, as indicated earlier.

FIG. 16 illustrates another alternative form of an open shaft 9 comprising an outer cylindrical part 49 provided with orifices 19, which is made to communicate with the bowl 6 for filing and diffusion of the liquid detergent composition, and an internal part 50, delimited by a cylindrical wall 48 with a circular base. The part 50 can receive at least one tablet 12 and/or one sachet 15, as shown. This part 50 is thus separated from the part of the device which is intended to contain the liquid detergent composition.

It can be seen, therefore, that the process of the invention can be implemented with a very wide variety of devices, of which solely illustrative examples have been given above.

The description which follows gives concrete examples of the use of the process for the invention with a device of the kind illustrated in FIGS. 1 to 16.

In these examples, the same single basic liquid detergent composition is employed, and is introduced into the device at a rate of a dose of approximately 180 g. This composition is the following:

| Ingredients | % by weight |
|---|---|
| Dodecenylsuccinic acid | 12 |
| Dodecylbenzenesulphonic acid | 12 |
| Alkylsulphonic acid | 4 |
| $C_{12}$—$C_{16}$ fatty alcohols - 7 moles of ethylene oxide per mole of alcohol | 16 |
| Citric acid | 1 |
| Protease (Maxatease R) - (1.5 AU/g) | 0.9 |
| Amylase (Maxamyl R) - (300,000 KNU/g) | 0.2 |
| Phosphonic acid | 0.8 |
| Ethanol | 8 |
| Minor constituents such as optical brightening agent, foam regulator based on a silicone emulsion, colorant, perfume, opacifier. | |
| Water | Remainder to 100 |

In accordance with the invention, at least one additive performing a specific function is associated with this basic liquid detergent composition. In what follows, concrete examples of the said additives are given, their percentage being shown as equivalent by weight relative to the basic liquid detergent composition. The actual weights of the solid product will vary according to the active concentrations of the additives or of the active constituents which they contain. It is clear that the physical form: gelatin capsules, tablets, sachets, and the like, must be taken into consideration in order to provide the appropriate quantity of additives which will be shown.

The description which follows lists certain additives, together with their specific function.

A. For better protection of the internal parts of the washing machine (new or worn machine):
1% of sodium silicates - immediate suspension.

B. For "renovating" worn or "pearled" cotton textiles. Improvement in the general appearance and softness of fabrics:
5% of cellulose-based enzymes - immediate dissolution.

C. For a softening action on fabrics:
5% of cellulose-based enzymes +0.2% of clay.

D. For better grease stain removal:
0.2% of enzymes (amylase) +1.2% of polyoxyethylene/polyoxypropyleneterephtlalate +3% of sodium laurylsulphate +3% of concentrated nonionic surfactant (Zoharex N.25 from Zoher, for example) +2% of soiling suspending agent (zeolites or polyacrylates) — immediate dissolution.

E. For better "oxidizable" soiling stain removal and superior whiteness on cottons:
14% of sodium perborate +4% TAED +0.5% diethylenetriaminepentamethylenephosphonic acid.

F. For a superior "brightness" of fabrics (improved bleaching):
2% of citric acid +0.2% of optical brightening agent (Stilbene type).

It will be noted that, in accordance with the process of the invention, a fabric wash with options can be carried out by employing one or more of the above-mentioned additives, in combination with the basic liquid detergent composition. It is obviously possible to combine the benefits of the constituents having specific function which are used separately from the said composition. For example in the case where the fabrics to be washed are worn and very dirty, a combination of additives A+C+D+E+F may be employed. It is also known that the process of the invention makes it possible to make the said additives available at predetermined times during the washing cycle, for example in some cases by exploiting their immediate action as soon as washing has commenced and, on the other hand, in the case of others, their delayed action (peroxygen compounds, softeners).

Practical machine washing trials carried out in accordance with the process of the invention have shown that this washing with options was being performed in an optimum manner, using very simple means.

In the above illustrative examples, the use of the process of the invention has been referred to essentially with a basic liquid detergent composition and separate components, but it will be understood that the process of the invention can be applied in the same manner to a basic detergent composition presented in a granular form. Although the detailed description given above illustrated a certain number of embodiments of devices to carry out the process of the invention, modifications or alternative forms can be employed by persons skilled in the art without departing from the scope of the present invention.

What we claim is:

1. Improved process for washing fabrics in a machine, in which a device comprising unoccluded vents and containing a detergent is employed, this device is placed with the fabrics to be washed in the drum of the machine and the machine is started up allowing the washing cycle to proceed, the said process being characterized in that a detergent composition is employed some of whose constituents are separate, in that at least one of the said constituents is introduced into the device and in that at least one other of the said constituents is associated separately with the said device with the result that, during the washing, all of the constituents diffuse into the fabrics and the washing bath, said separate constituent being provided in a handleable unit form selected from the group consisting of pouches, tablets and capsules.

2. Process according to claim 1, characterized in that the separate constituent has a characteristic color, so that the user may adapt the formulation of the detergent composition to the precise need of the washing, as a function of the state of soiling of the fabrics, according to the color use instructions the user is given.

* * * * *

UNITED STATES PATENT AND TRADEMARK OFFICE

CERTIFICATE OF CORRECTION

PATENT NO. : 5,129,120

DATED : July 14, 1992

INVENTOR(S) : H. Cornette, J. Arnau-Munoz

It is certified that error appears in the above-identified patent and that said Letters Patent is hereby corrected as shown below:

On title page, Attorney, Agent, or Firm: delete "Jacobus C. Rasser"

Signed and Sealed this

Twenty-fourth Day of August, 1993

Bruce Lehman

*Attest:*

BRUCE LEHMAN

*Attesting Officer*

*Commissioner of Patents and Trademarks*